US006796810B2

(12) United States Patent
DelPrete et al.

(10) Patent No.: US 6,796,810 B2
(45) Date of Patent: Sep. 28, 2004

(54) CONDUCTIVE ELASTOMERIC CONTACT SYSTEM

(75) Inventors: Stephen D. DelPrete, Rehoboth, MA (US); Jeffrey W. Mason, Attleboro, MA (US); Michael L. Kirkman, Swansea, MA (US); Steven B. Wakefield, Watertown, MA (US); William R. Arsenault, Warwick, RI (US); Shiraz Sameja, Attleboro, MA (US); Peter D. Wapenski, Foster, RI (US); Arthur G. Michaud, Fairhaven, MA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/315,299

(22) Filed: Dec. 10, 2002

(65) Prior Publication Data

US 2004/0110400 A1 Jun. 10, 2004

(51) Int. Cl.[7] ..... H01R 4/58
(52) U.S. Cl. ..... 439/86; 439/66; 439/91
(58) Field of Search ..... 439/66, 91, 86, 439/74

(56) References Cited

U.S. PATENT DOCUMENTS

| | | | | |
|---|---|---|---|---|
| 3,971,610 | A | 7/1976 | Buchoff et al. | 339/17 R |
| 5,599,193 | A | 2/1997 | Crotzer | 439/66 |
| 5,624,268 | A | 4/1997 | Maeda et al. | 439/66 |
| 6,056,557 | A | 5/2000 | Crotzer et al. | 439/66 |
| 6,264,476 | B1 * | 7/2001 | Li et al. | 439/66 |
| 6,271,482 | B1 | 8/2001 | Crotzer et al. | 174/262 |
| 6,348,659 | B1 | 2/2002 | Crotzer et al. | 174/68.1 |
| 6,370,770 | B1 * | 4/2002 | Fan et al. | 29/877 |
| 6,595,784 | B2 * | 7/2003 | Brodsky et al. | 439/66 |

* cited by examiner

*Primary Examiner*—Alex Gilman

(57) ABSTRACT

A connector for board-to-board or board-to-socket interconnect applications includes a plurality of conductive elastomeric columnar contacts surrounded by an insulative body. In one embodiment employed in board-to-board applications, the columnar contacts are substantially longer than wide to facilitate mounting of components between opposed boards. The conductive columnar contacts extend slightly beyond the surfaces of the insulative body. The body may include integral raised collars that surround opposing ends of the conductive columnar contacts and at least one stop flange integral with the body that limits overstress on tips of the conductive columnar contacts.

13 Claims, 10 Drawing Sheets

CONDUCTIVE ELASTOMERIC CONTACT SYSTEM

CROSS REFERENCE TO RELATED APPLICATIONS n/a

STATEMENT REGARDING FEDERALLY SPONSORED RESEARCH OR DEVELOPMENT n/a

BACKGROUND OF THE INVENTION

The present invention relates to connectors and more specifically to a connector that utilizes conductive elastomeric columnar contacts and is adapted for use in board-to-board applications and for coupling integrated circuit sockets to a printed circuit board.

Board-to-board interconnect devices using elastomeric conductive members are known. One such interconnect device is disclosed in U.S. Pat. No. 6,056,557. In this interconnect device, conductive resilient members are disposed in holes in a substrate on a predetermined grid array and the assembly is positioned between adjacent printed circuit boards so as to make conductive contact between conductive pads on opposing boards.

Another device that uses conductive elastomeric columns for interconnecting a semiconductor device to a printed circuit board in disclosed in U.S. Pat. No. 5,624,268.

In board-to-board interconnect applications, however, it is sometimes desirable to have the boards separated by a distance sufficient to permit electrical components and semiconductor devices to be mounted to and between and the opposing printed circuit boards. This application requires that the length of the conductive members be substantially greater than contemplated in prior art connectors employing resilient conductive members. The pre-existing interconnect devices that employ elastomeric conductive column are not of a sufficient height to permit the use of such devices in anything other than a close opposed relationship due to the height of the conductive columns. Moreover, due to the resilience and the instability of the conductive columns as the height of such columns increases, interconnects employing conductive elastomeric columns have not been employed except in applications involving close board-to-board spacings or in applications involving the interconnection of a semiconductor device to a printed circuit board.

Additionally, in certain applications it is desirable to be able to conductively couple an integrated circuit device socket, such as a Bail Grid Array (BGA) device socket or a Land Grid Array (LGA device socket to a printed circuit board. In such applications, the contacts are closely spaced and the connector must maintain tight mechanical tolerances to properly couple the contacts of the respective device socket to the corresponding contacts on the printed circuit board.

Accordingly, it would be desirable to have a connector design that employs conductive elastomeric columnar contacts and that permits board to board interconnections with large interboard spacings. Additionally, it would be desirable if the connector design was suitable for conductively coupling BGA and LGA device sockets to a printed circuit board. It would further be desirable to have a method for producing such connectors in an efficient manner that is applicable to high volume manufacturing techniques.

BRIEF SUMMARY OF THE INVENTION

A connector for use in board-to-board or board to device socket interconnect applications comprises a plurality of conductive elastomeric columnar contacts arranged in a predetermined pattern. The elastomeric columnar contacts are surrounded by a supporting polymer, such as silicone, to provide support for and prevent deformation of the conductive elastomeric columnar contacts.

In one embodiment of the invention, a plurality of conductive elastomeric columnar contacts are supported by a substrate such as a polyimide sheet to form a contact assembly. The contact assembly is positioned within in a mold and an insulative supporting material, such as silicon, is injected into the mold so as to surround the conductive elastomeric columnar contacts. The tips of the conductive elastomeric columnar contacts extend outboard of the surface of the cured insulative supporting material to allow the tips of the columnar contacts to make conductive contact with corresponding pads located on opposing printed circuit boards. To avoid overstress of the tips of the columnar contacts, a stop flange may be provided that limits the deformation of the tip of the elastomeric columnar contact. The stop flange may be provided an a singular raised portion that extends above the opposing surfaces of the body along the periphery of the body surface. Alternatively the stop flange may be provided as a plurality of raised areas that serve to resist compression of the columnar contacts beyond to predefined limit.

In one embodiment, the mold is configured so that the supporting material forms a non-conductive raised collar around the opposing ends of the conductive columns although the tips of the columnar contacts extend beyond the upper surface of the raised collars to allow the tips to make conductive contact with corresponding contacts on a circuit board.

A connector in accordance with the present invention may be produced by molding the body of supporting non-conductive material around the contact assembly. Alternatively, a body of non-conductive supporting material may be molded in a first molding operation and the conductive elastomeric material may be molded into through-holes in the body in a secondary molding operation to form the conductive elastomeric columnar contacts.

Other features, aspects and advantages of the above described connector and methods of making the same will be apparent to those of ordinary skill in the art from the detailed description of the invention that follows.

BRIEF DESCRIPTION OF THE SEVERAL VIEWS OF THE DRAWING

The invention will be more fully understood by reference to the following Detailed Description of the Invention in conjunction with the drawing of which.

DETAILED DESCRIPTION OF THE INVENTION

Figure 1:
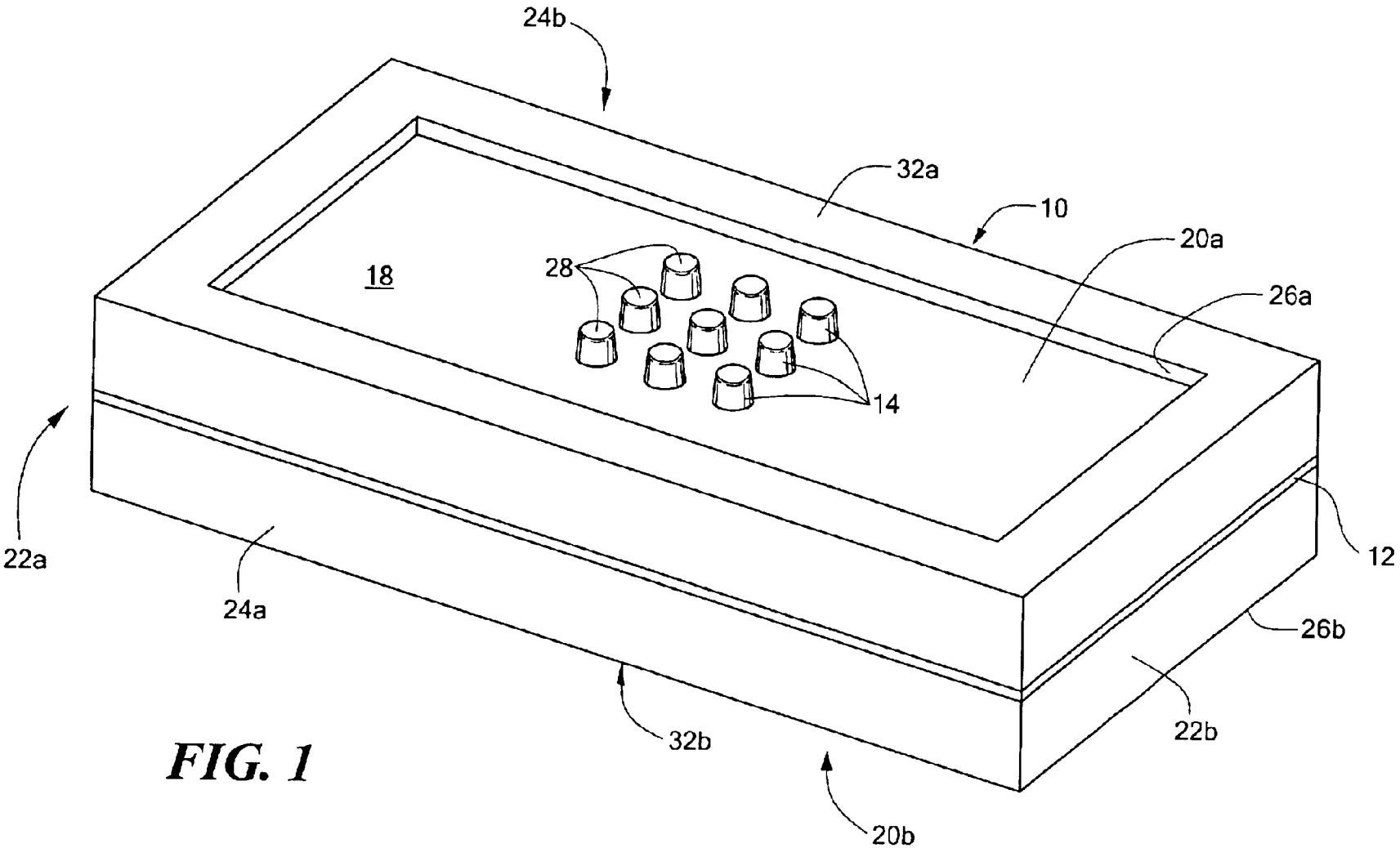
FIG. 1 is a perspective view of one embodiment of a connector in accordance with the present invention.
Figure 2:
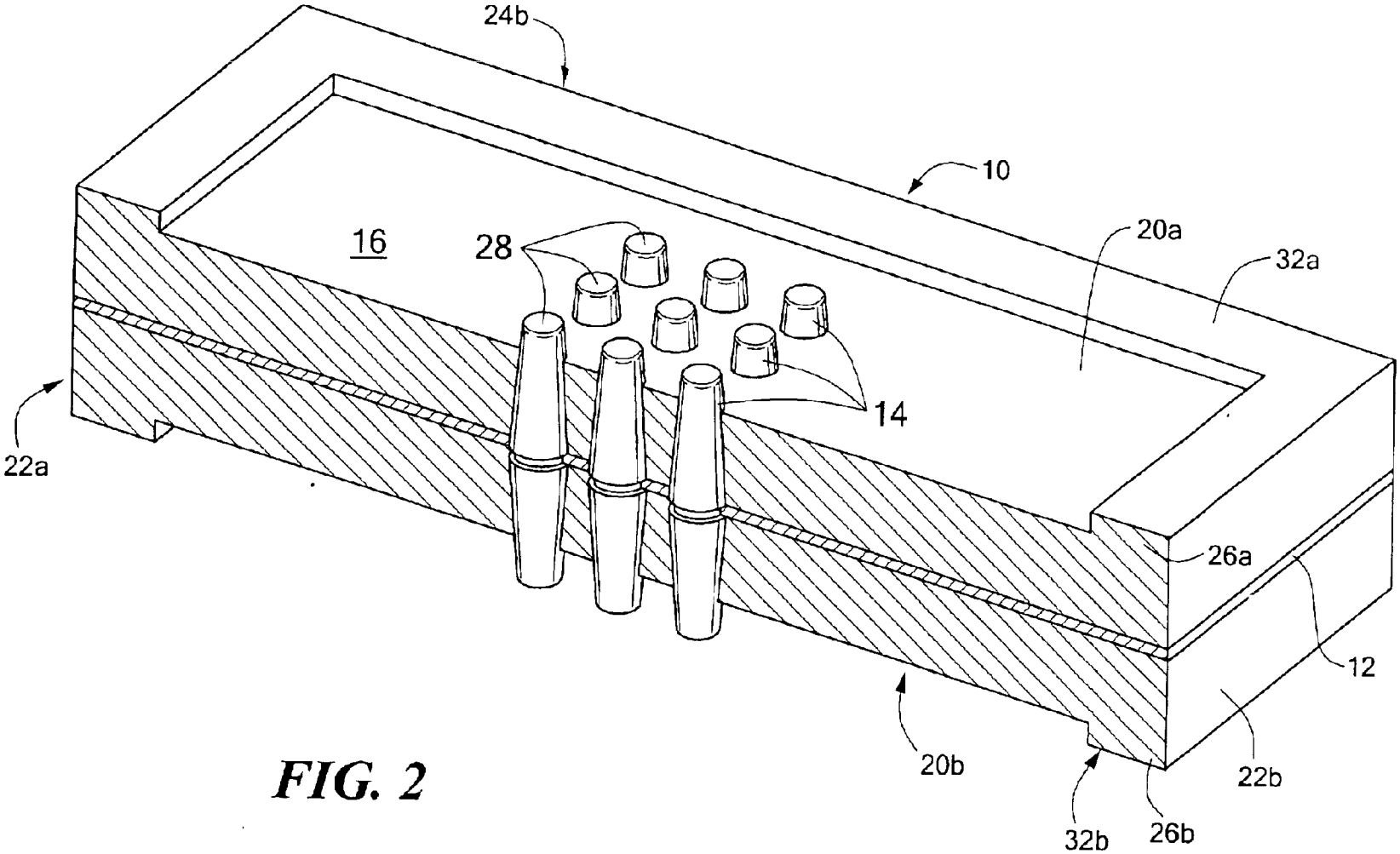
FIG. 2 is a partial cutaway perspective view of the connector of FIG. 1.

A connector for making a board-to-board electrical interconnections and board to device socket interconnections and a method for making the connector is disclosed. One embodiment of the connector is depicted in FIGS. 1–4. Referring to the FIGS. 1–4, a connector 10 includes a substrate 12 such as a polyimide sheet, and a plurality of conductive elastomeric columnar contacts 14 mounted within the substrate 12. The columnar contacts 14 and substrate 12 form a contact assembly 16 (FIG. 4) that is subsequently discussed in greater detail. The connector 10 further includes a body 18 of insulative material that is molded in supporting relation around the columnar contacts 14.

The body 18 has upper and lower opposing surfaces 20*a*, 20*b* respectively, opposing ends 22*a*, 22*b* and opposing sides 24*a*, 24*b*. The body 18 further includes stop flanges 26*a*, 26*b* that are integrally formed with the body 18 and extend around the periphery of the upper and lower surfaces 20*a* and 20*b* respectively of the body 18. The stop flanges 26*a*, 26*b* may comprise a continuous structure or alternatively, may comprise a plurality of distinct raised areas that extend above the upper and lower surfaces 20*a*, 20*b* of the body 18. The function of the stop flanges 26*a*, 26*b* is discussed subsequently in greater detail.

In the illustrated embodiment, the connector body 18 has generally rectangular top, side and end profiles although the shape and height of the body 18 and the height of the columnar contacts 14 may vary based upon particular design criteria. It is noted that in one embodiment of the connector 10 the height of the columnar contacts 14 is substantially greater than the width of the contacts 14 to accommodate the desired spacing between circuit boards to be conductively mated while allowing for a close spacing between adjacent columnar contacts 14. In an other embodiment of the connector 10 employed for board to device socket applications, the columnar contacts 14 need not have a height substantially greater than the width of the contacts 14.

The conductive elastomeric columnar contacts 14 have opposing tips 28 that are located slightly above and below the upper and lower surfaces 20*a*, 20*b* of the connector body 18 and respective stop flanges 26*a*, 26*b* (if present) so as to be able to make conductive contact with corresponding contacts on mating printed circuit boards (not shown).

When designed for the board-to-board application, the height of the columnar contacts 14 and the height of the connector body 18 are specified so as to provide a connector 10 of sufficient height to permit desired components to be mounted on one or both of the opposing printed circuit boards and between the printed circuit boards. The elastomeric columnar contacts 14 may be produced via any suitable method known in the art.

Figure 3A:
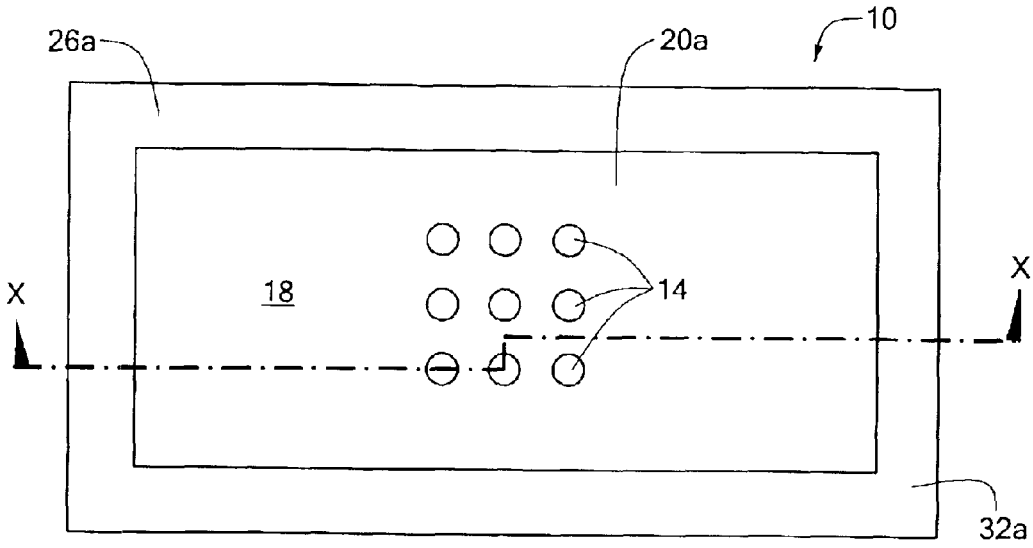
FIG. 3*a* is a top view of the connector of FIG. 1.
Figure 3B:
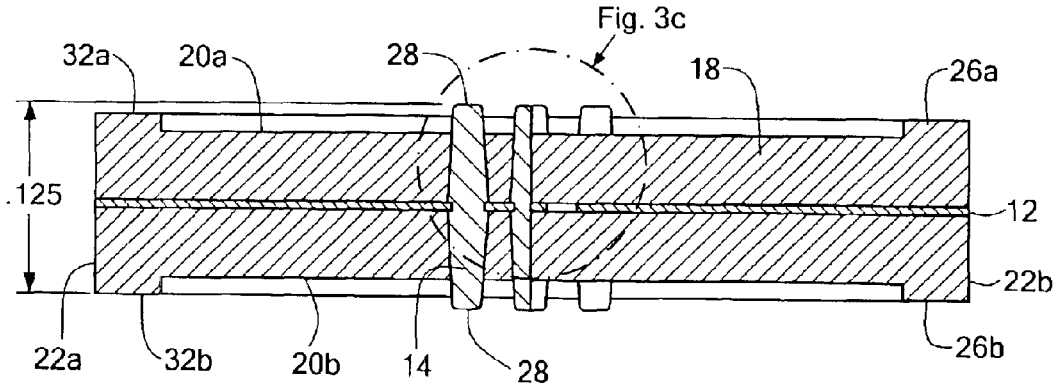
FIG. 3*b* is a cross-sectional side view of the connector shown in FIG. 3*a;*
Figure 3C:
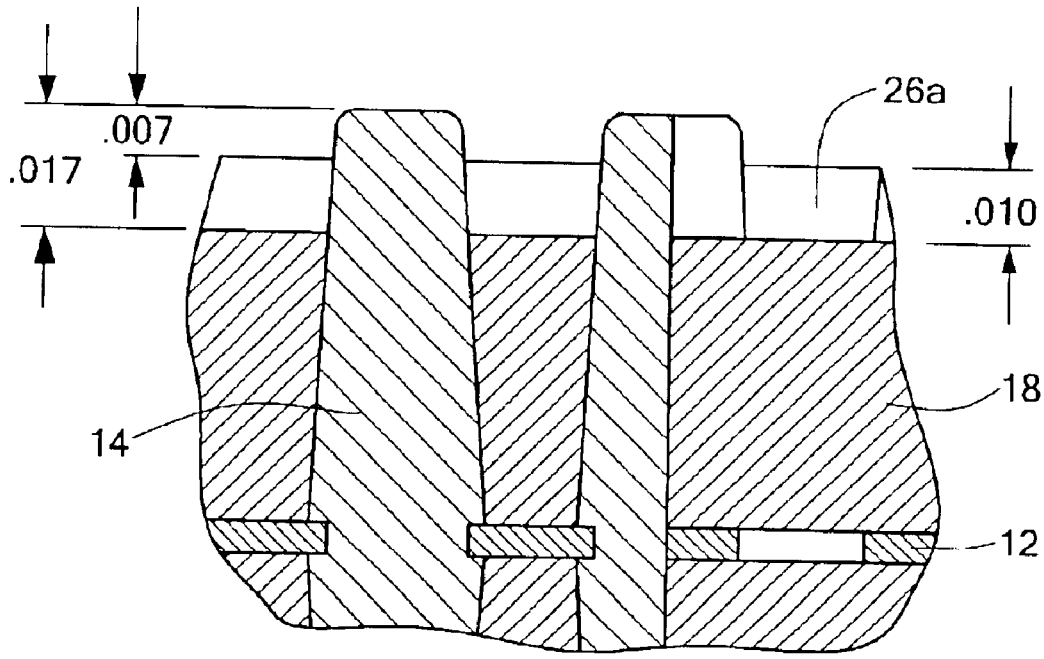
FIG. 3*c* is an enlarged view of a portion of the cross-sectional side view of the connector depicted in FIG. 3*b;*

The structure of the connector 10 is depicted in greater detail in FIGS. 3*a*–3*c*. In the embodiment depicted in FIGS. 3*a*–3*c*, the substrate 12 terminates at the ends 22*a*, 22*b* and sides 24*a*, 24*b* of the body 18 although the substrate 12 may extend beyond the ends and the sides of the body 18. More specifically, in certain applications, it is desirable to use holes in the substrate that are located external to the body 18 to align the contact assembly 16 during the molding process as subsequently discussed and/or to align the connector 10 during the mounting of the connector 10 in board to board interconnect application.

FIG. 3*b* depicts a side cross-sectional view of the connector 10 of FIG. 3*a* through section X—X depicted in FIG. 3*a*. In the illustrative embodiment the overall height of the columnar contacts 14 is 0.125 inch. The upper and lower surfaces of the stop flanges 26*a*, 26*b* extend 0.010 inch beyond the upper and lower surfaces 20*a*, 20*b* of the body 18 respectively, the tips 28 of the columnar contacts 14 extend 0.017 inch beyond the surfaces 20*a* and 20*b* of the body 18 respectively and the tips 28 of the columnar contacts 14 are located 0.007 inch beyond the respective stop flanges 26*a* and 26*b* respectively. The tips 28 of the columnar contacts 14 extend slightly beyond the upper and lower stop flanges 26*a* and 26*b* respectively to assure that the columnar contacts 14 make conductive contact with corresponding contacts on a circuit board when the connector 10 is disposed in a mounting position with respect to the printed circuit board. More specifically, the stop flanges 26*a*, 26*b* prevent overstress on the tips 28 of the columnar contacts 14 by preventing the tips 28 of the columnar contacts 14 from being compressed excessively upon mating of the connector 10 with a circuit board. The thickness of the body 18 is substantially coextensive with the height of the columnar contacts 14 noting that the thickness is slightly less than the height of the columnar contacts 14 in order to provide support for the columnar contacts 14 over their height of the respective contacts 14 while allowing the tips 28 of the columnar contact to be under compression when mated with a contacts of a circuit board. By supporting the columnar contacts 14 substantially along the entire height of the contacts 14 significant deformation of the columnar contacts 14 and bending of the columnar contacts 14 along their height is prevented. Additionally, by having the thickness of the body substantially co-extensive with the height of the columnar contacts 14, deformation of the columnar contact 14 is limited largely to the contact tips 28. Via this structure, a good conductive connection between the contact tips 28 and corresponding contacts on cooperative printed circuit boards can be maintained. It should be appreciated that the dimensions employed in any given application may vary based upon specific connector design requirements.

Figure 4:
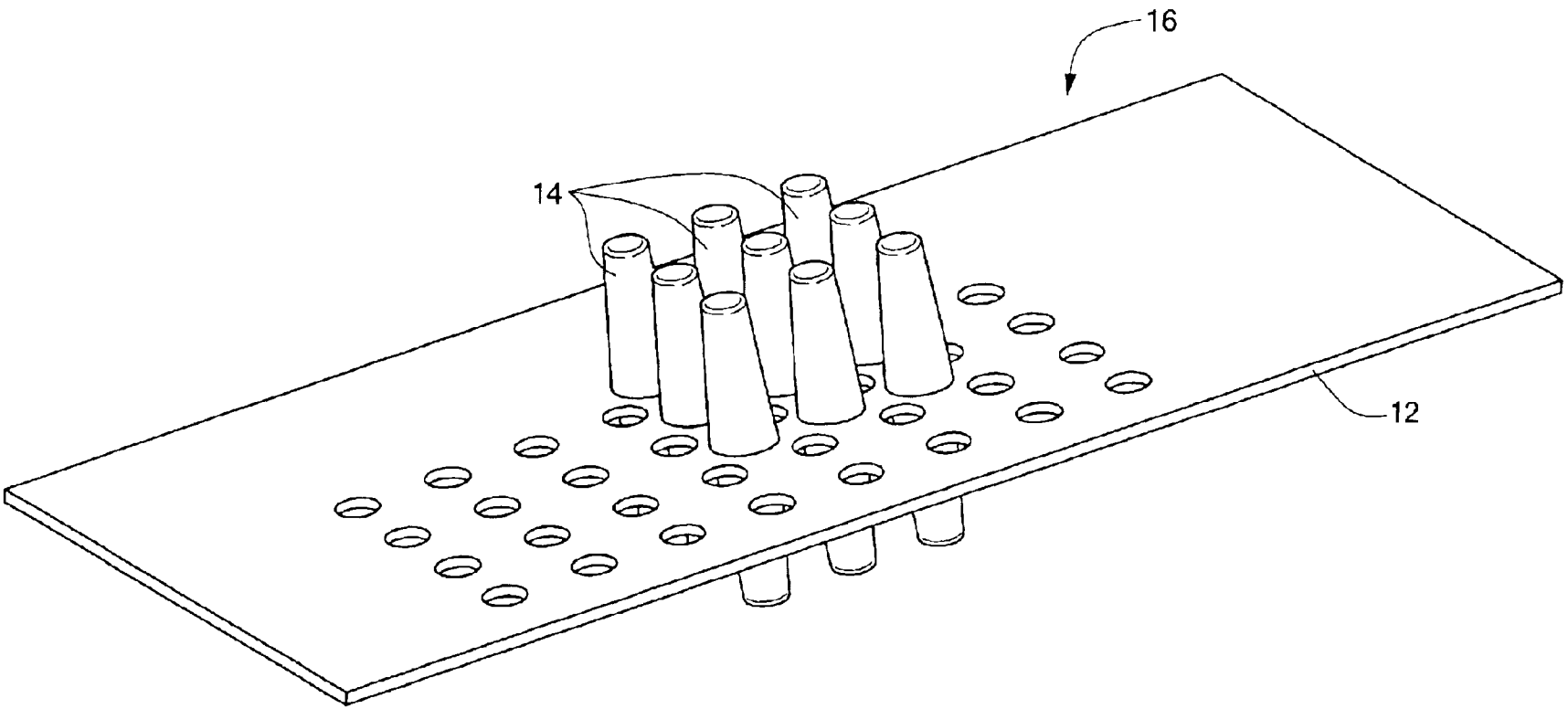
FIG. 4 is a perspective view of a contact assembly showing a plurality of conductive elastomeric columnar contacts mounted in a substrate.

A method for producing a connector 10 of the type depicted in FIG. 1 is illustrated with reference to FIGS. 4–6. More specifically, referring to FIG. 4, the contact assembly 16 is produced in a first molding operation. The substrate 12 may comprise a polyimide sheet sold under the name KAPTON™, a polyimide sheet sold under the name CIRLEX™ or a substrate of any other suitable material. Holes are provided through the substrate 12 in a predetermined hole pattern that corresponds to a contact pattern on circuit boards to which the connector 10 is to be mated. Additional holes may be provided in the substrate 12 for reasons later discussed. The substrate 12 is positioned within a first mold (not shown) and the conductive elastomeric columnar contacts 14 are molded with each contact centerline passing through one of the holes in the substrate 12. The diameter of the elastomeric columnar contacts immediately above and below the substrate 12 is greater than the diameter of the corresponding through hole in the substrate 12. Consequently, the columnar contacts 14 are fixedly mounted to the substrate 12 following the first molding operation. In the illustrated embodiment, the columnar contacts 14 are molded in the form of integral upper and lower frustrums extending above and below the substrate 12. It is recognized that the columnar contacts may be molded into as cylinders or any other suitable molded columnar shape. The height of the elastomeric contacts 14, in one embodiment, is specified so as to accommodate the desired board to board spacing between opposing printed circuit boards. The elastomeric contacts 14 are typically shorter when employed in a board to device interconnect application, e.g. for coupling an LGA or BGA socket to a printed circuit board.

Figure 5:
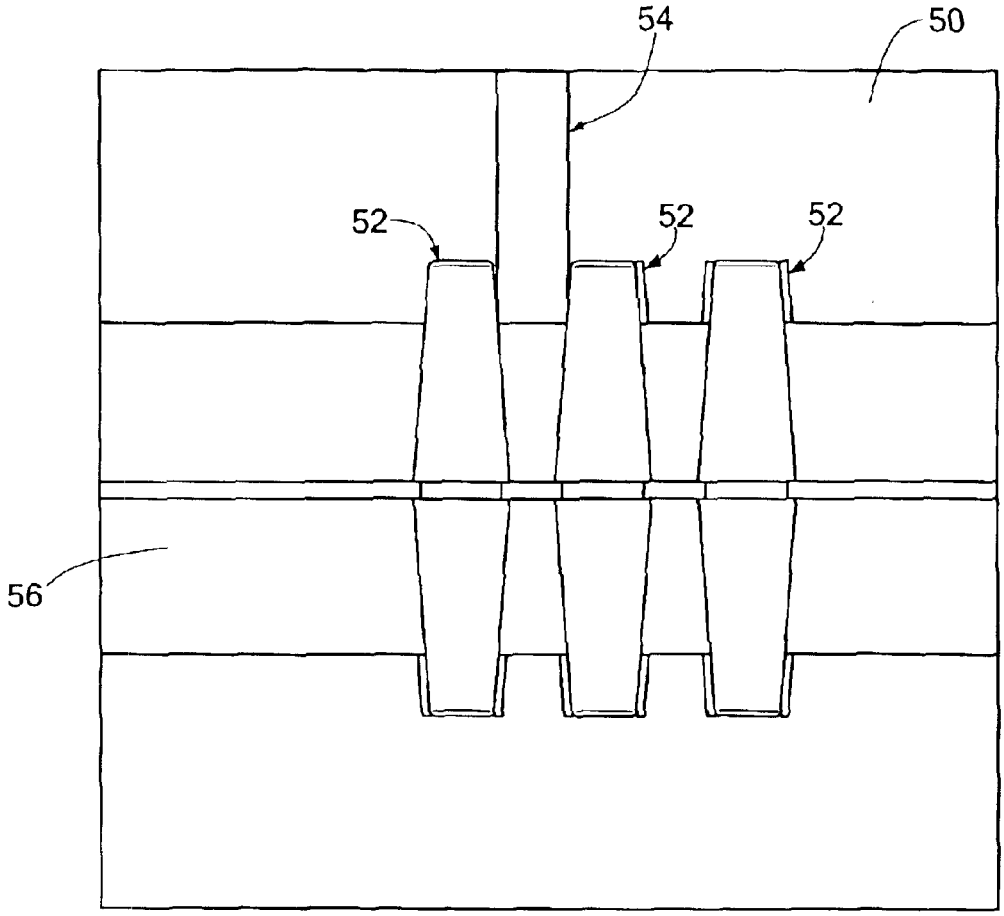
FIG. 5 is a partial cross-sectional side view showing the contact assembly of FIG. 4 disposed in a mold.
Figure 6:
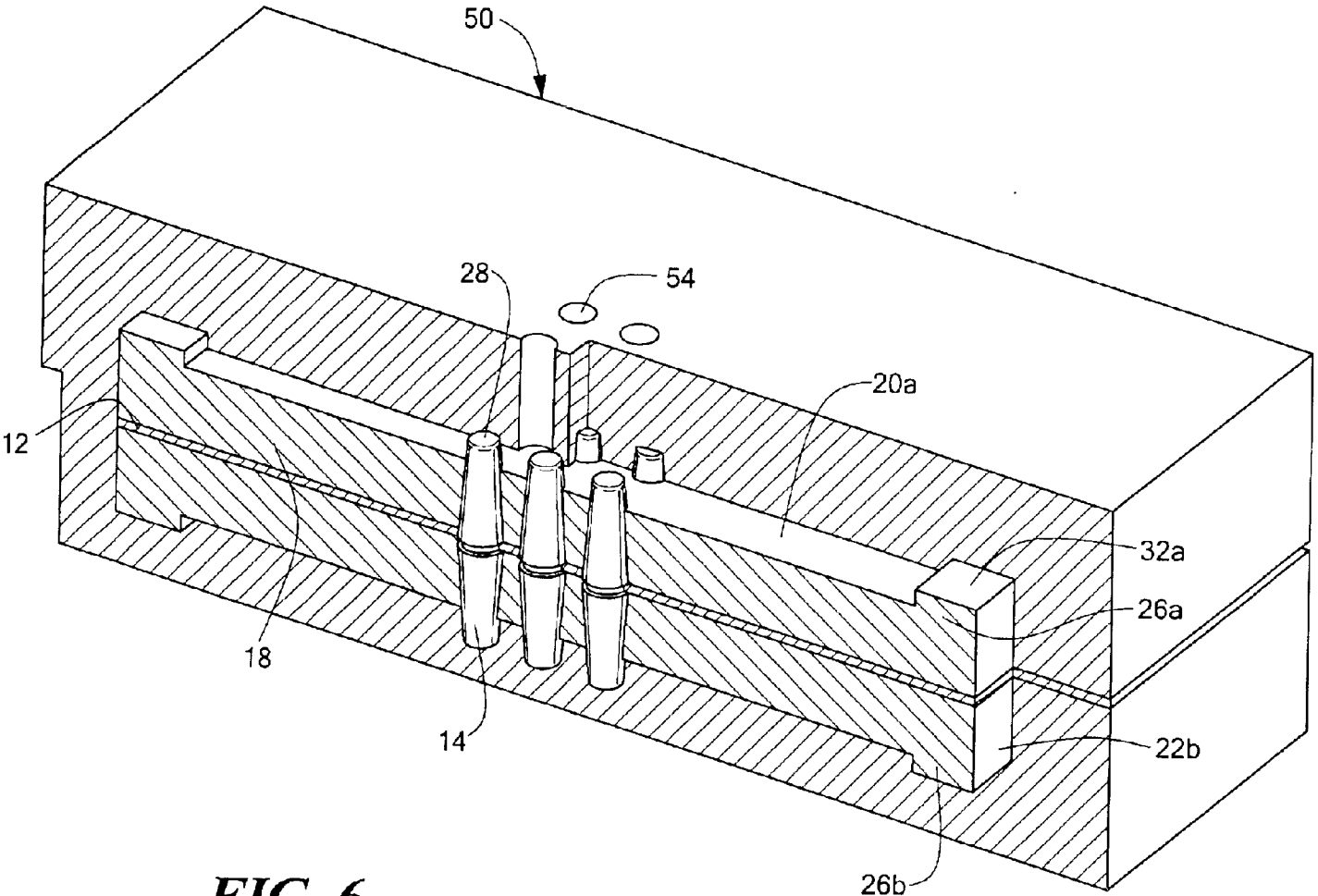
FIG. 6 is a perspective cutaway view illustrating the molding of the body of the connector around the contact assembly.

The contact assembly 16 thus formed in the first molding operation is removed from the first mold 40 and positioned within a second mold 50 such that opposing tips 28 of the columnar contacts 14 are disposed in recesses 52 provided in upper and lower portions of the second mold 50 (FIG. 5). An input port 54 is provided in the second mold 50 for injection of the body material into the second mold 50. More specifically, during the second molding operation, the body material, such as an insulative silicone compound or any other suitable compound, is injected into the second mold under pressure via the input port 54 so that the body material fills the second mold 54 cavity 56 and surrounds the columnar contacts 14. The body material flows through one or more holes provided in the substrate 12 that do not do not contain columnar contacts 14. Alternatively, input ports 54 on opposing sides of the substrate may be employed.

Following the second molding operation, as illustrated in exemplary FIG. 6, the molded connector 10 body 18 is contained within the second mold 50 and the tips 28 of the columnar contacts 14 extend slightly above and below the upper and lower surfaces of the upper and lower stop flanges 26*a* and 26*b* respectively. The connector 10 is removed from the second mold 50 substantially in the form depicted in exemplary FIG. 1. As previously discussed, the substrate 12 may terminate at the ends 22*a*, 22*b* and/or sides 24*a*, 24*b* of the connector 10 or alternatively, extend beyond the ends 22*a*, 22*b* and/or sides 24*a*, 24*b* of the connector 10. In those situations in which the substrate 12 extends outboard of the connector 10 body 18, holes may be provided in the substrate 12 to be used for aligning the substrate during the first or second molding operations or in the mounting of the connector in a board-to-board interconnect. Additionally, alignment holes (not shown) may be provided in the substrate 12 so as to be located within the first and/or second molds and such alignment holes may be used to align the substrate 12 or contact assembly 16, as applicable during the first and/or second molding operations.

Figure 7:
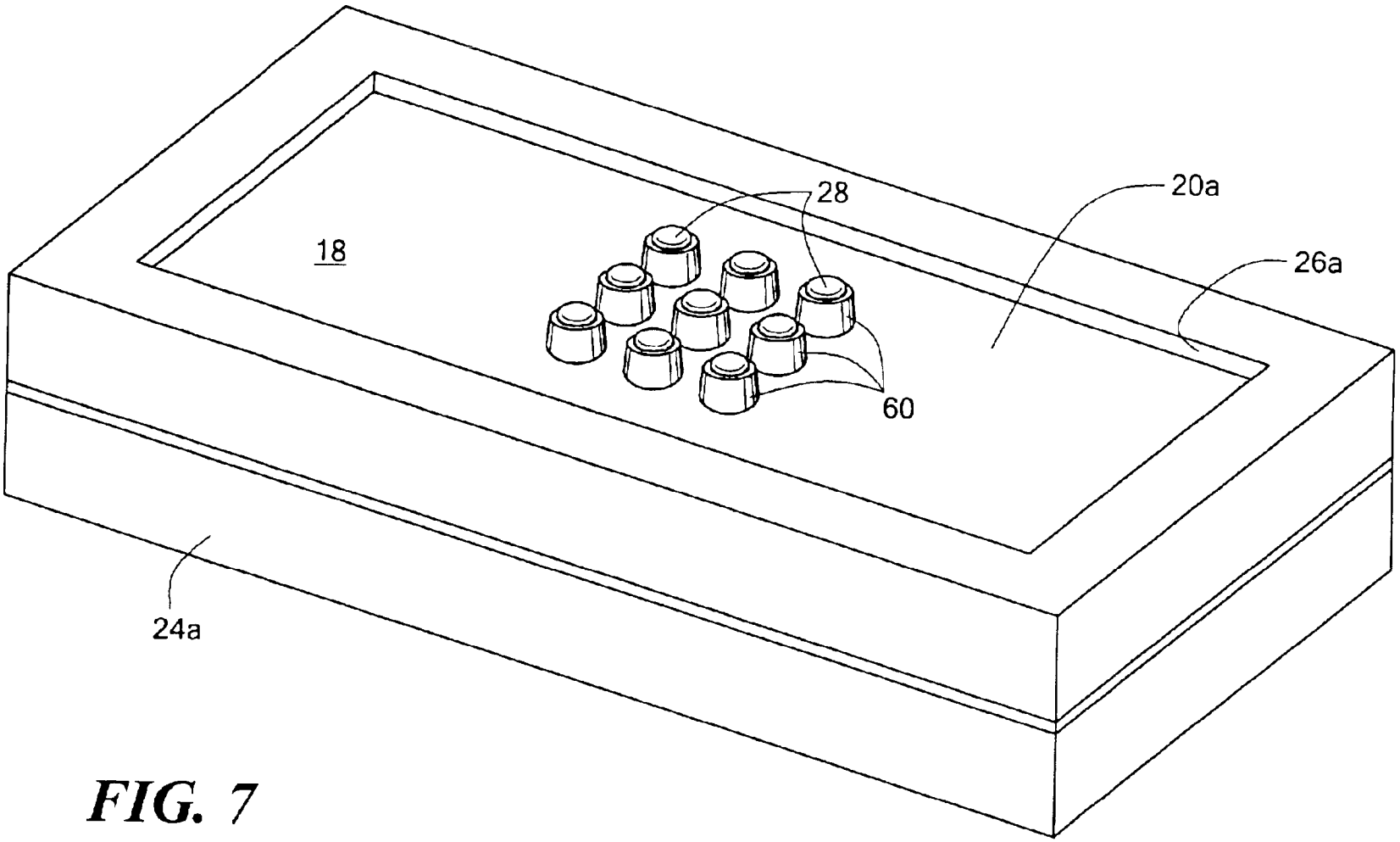
FIG. 7 is a perspective view of another embodiment of a connector in accordance with the present invention including supportive raised collars surrounding the ends of the columnar contacts.
Figure 8A:
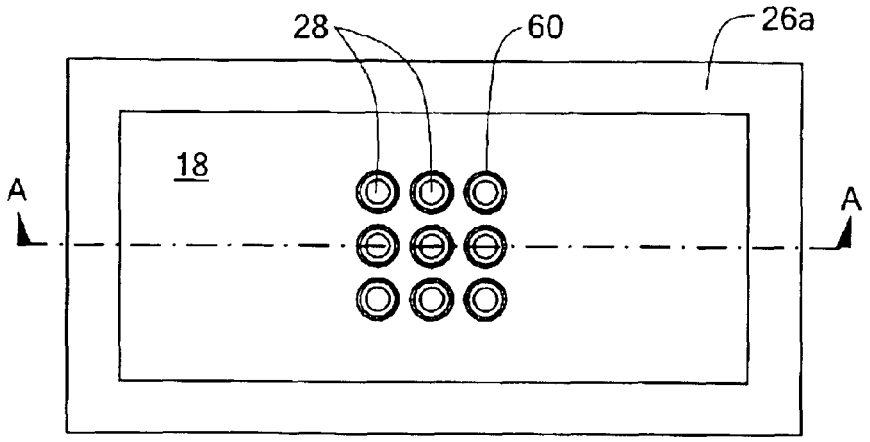
FIG. 8*a* is a top view of the connector of FIG. 7.
Figure 8B:
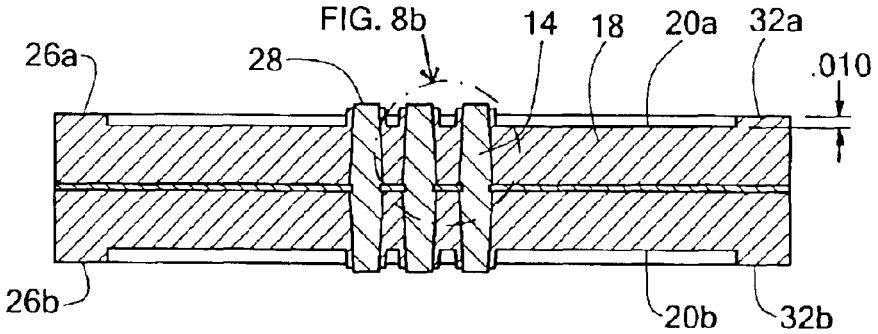
FIG. 8*b* is a cross-sectional side view of the connector of FIG. 7.
Figure 8C:
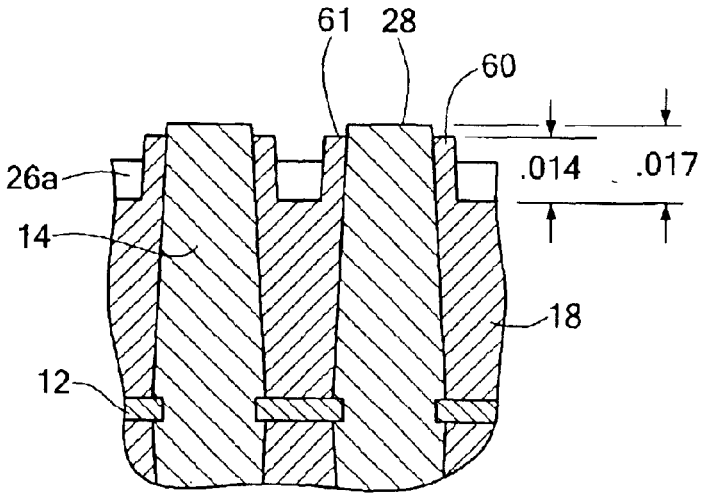
FIG. 8*c* is an enlarged view of a portion of the cross-sectional side view of the connector depicted in FIG. 8*b;*

A second embodiment of the invention is depicted in FIGS. 7 and 8*a*–8*c*. More specifically, the second embodiment depicted in FIG. 7 is generally similar to the connector 10 depicted in FIG. 1, however, collars 60 are integrally molded with the body 18 around the tips 28 of the conductive elastomeric contacts 14. The collars 60 provide additional support for the tips 28 of the columnar contacts 14 so as to minimize deformation of the respective ends of the columnar contacts 14. In the illustrated embodiment, the outer ends 61 of the collars 60 extend 0.014 inch beyond the body surfaces 20*a*, 20*b* and the tips 28 of the columnar contacts 14 extend 0.017 inch beyond the body surfaces 20*a*, 20*a*. In the present embodiment, the surfaces 32*a*, 32*b* of the stop flanges 26*a*, 26*b* extend 0.010 inch beyond the body 18 surfaces 20*a*, 20*b* respectively. Thus, the outer ends 61 of the collars 60 extend slightly beyond the surfaces 32*a*, 32*b* of the respective stop flanges 26*a*, 26*b*. Since the body 18 is formed of a deformable material, and the collars 60 have a diameter only slightly greater than the diameter of the columnar contacts 14 adjacent the tips 28, upon compression of the tips 28, the collars 60 also deform while providing support for the tips 28 of the columnar contacts 14. While specific dimensions are shown for purposes of illustration, it should be apparent that the specific dimensions may vary for based upon the particular application of interest. The embodiment depicted in FIG. 7 is formed via the method discussed above for the connector depicted in FIG. 1. More specifically, a contact assembly 16 is formed in a first molding operation and, in a second molding operation, the body 18 including the collars 60 is molded around the contact assembly 16.

Figure 9A:
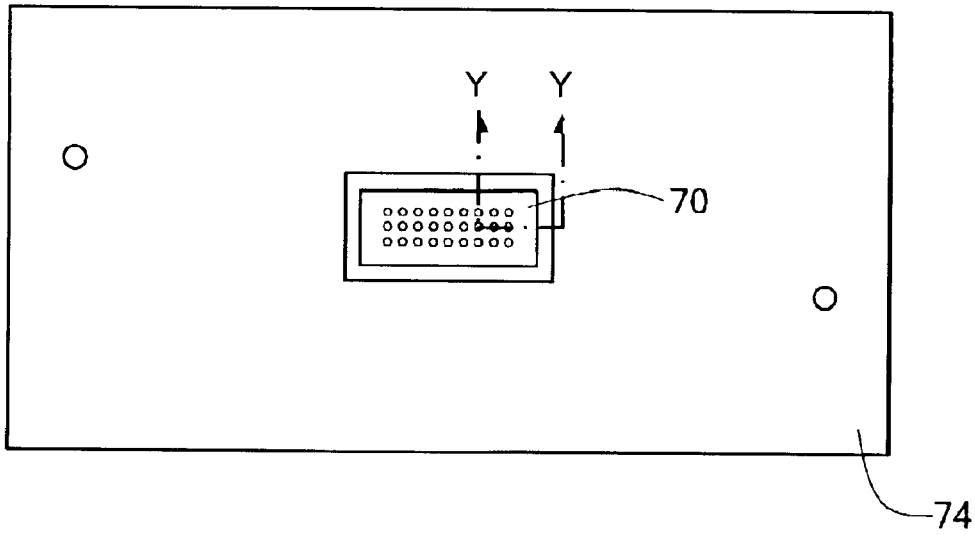
FIG. 9*a* is a top view of another embodiment of a connector in accordance with the present invention in which conductive elastomeric contacts are molded into a pre-molded body in a secondary molding operation.
Figure 9B:
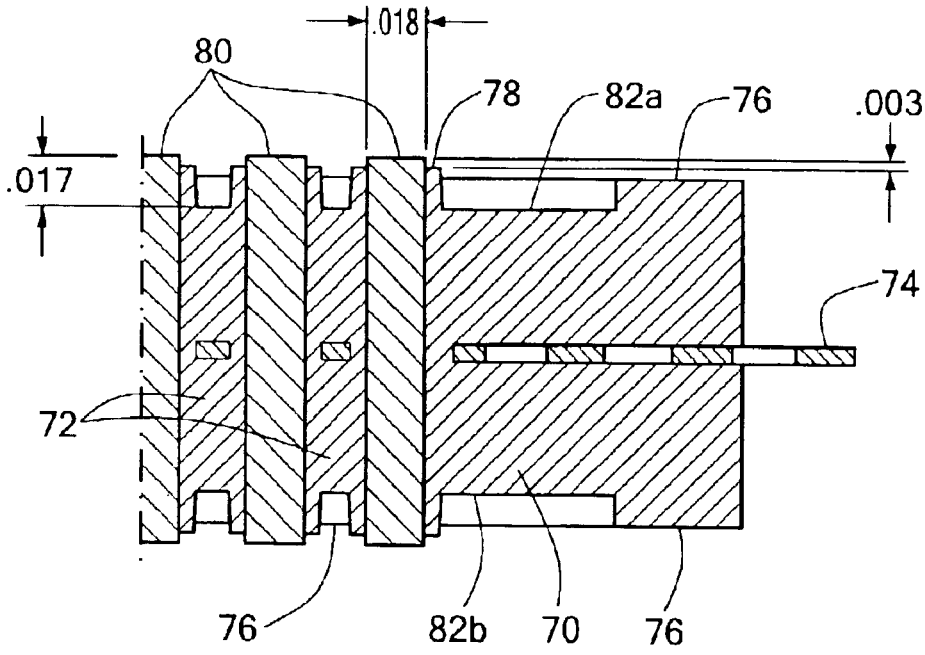
FIG. 9*b* is a partial side view of the connector of FIG. 8*a*.

In another embodiment of the invention depicted in FIGS. 9*a* and 9*b*, a connector body 70 is molded in a first molding operation and, in a secondary molding operation, conductive elastomeric columnar contacts 72 are molded into through holes in the connector body 70. More specifically, in the first molding operation, the connector body 70 is formed. The connector body 70 includes a plurality of through-holes arranged in a predetermined pattern. The pattern corresponds, at least in part, to a pattern of contacts on mating printed circuit boards (not shown). The connector body 70 may be formed either with a substrate 74, such as a polyimide sheet or any other suitable substrate, or alternatively, the connector body 70 may be molded without such a substrate. When the connected body 70 is molded around a substrate 74, the substrate 74 will have holes extending through the substrate in a pattern corresponding to the through-hole pattern molded into the connector body 70. Following the initial molding operation, in a secondary molding operation, conductive elastomeric columnar contacts 14 are molded into the through holes in the body 70 such that tips 80 of the conductive elastomeric contacts 72 extend above and below the upper and lower surfaces 82*a*, 82*b* of the body 70. More specifically, the tips 80 of the contacts 72 extend slightly above the ends of collars 78 molded into the body 70 and around the contacts 72. As discussed above, in connection with FIG. 1, a stop flange 76 may be provided to prevent excessive deformation of the tips 80 of the columnar contacts 72 when the connector is mounted in a board to board interconnect application. While FIG. 9*b* depicts integrally formed collars 78 molded into the body 70, it should be appreciated that the connector body 70 may be molded with or without the collars 78. The collars 78 provide mechanical support for the columnar contacts 72 as discussed hereinabove.

While the tips of the columnar contacts are depicted as being generally planar at the tip ends, the tips may be hemispherical, conical or of any other suitable shape to engage a mating contact pad. Additionally, while the contacts are depicted as being in the form or complementary frustrums or generally cylindrical, it should be appreciated that the contacts may be formed of any suitable cross section. More specifically, the contacts may have a square cross-section, elliptical cross-section and may taper to suit particular connector applications provided the length of the respective contacts are substantially greater than the width of the contact.

It will be appreciated by those of ordinary skill in the art that modifications to and variations of the above described connectors and methods of producing the same may be made without departing from the inventive concepts disclosed herein. Accordingly, the invention should not be viewed as limited except as by the scope and spirit of the appended claims.

What is claimed is:

1. A connector comprising:

a plurality of parallel conductive elastomeric columnar contacts arranged in a predetermined contact pattern, each contact having tips on opposing ends and having a contact length and a contact width; and a body formed of a first insulative resilient material, said body having a thickness defined by first and second opposing surfaces, said body surrounding said columnar contacts in abutting relationship, said body including a plurality of collars integrally formed with said body of said first insulative material as a unitary structure, said collars extending from said first and second opposing surfaces to collar ends and surrounding and abutting respective ends of said contacts, said contact tips extending slightly outboard of said collar ends.

2. The connector of claim 1 wherein said insulative body comprises an insulative silicone body.

3. The connector of claim 1 further including an insulative substrate formed of a second insulative material different from said first insulative material, said substrate disposed between said first and second opposing surfaces and generally parallel thereto, said insulative substrate having a plurality of holes in the substrate arranged in said predetermined pattern, wherein each of said columnar contacts passes through one of said holes in said substrate.

4. The connector of claim 1 wherein said tips of said contacts extend several thousandths of an inch outboard of said collar ends.

5. The connect or of claim 1 wherein said tips of said contacts extend approximately 0.003 inch outboard of said collar ends.

6. The connector of claim 1 wherein at least some of said tips of said contacts have planar ends.

7. The connector of claim 1 wherein at least some of said tips of said contacts have hemispherical ends.

8. The connector of claim 1 wherein at least some of said tips of said contacts have conical ends.

9. The connector of claim 1 wherein said collars each have a base with a first diameter, an outer end with a second diameter and a height defined by the distance between said base and said outer end and said outer ends of said collars are spaced from the respective first and second surfaces by a distance equal to said height.

10. The connector of claim 9 wherein said collars comprise frustrums having a frustum base of a first diameter, a frustum outer end of a second diameter that is less than said first diameter, a through bore extending from said frustum outer end to said frustum base, wherein said frustum base corresponds to said collar base and said frustum outer end corresponds to said collar outer end.

11. The connector of claim 9 wherein said height is approximately 0.014 inch.

12. The connector of claim 9 further including at least one stop flange extending from each of said first and second opposing surfaces, each of said at least one stop flange being formed integrally with said body of said first material and having a stop flange base coplanar with the respective one of said first and second surfaces and a stop flange top surface parallel to said stop flange base and spaced therefrom by a distance less than said height.

13. The connector of claim 12 wherein said at least one stop flange extended around the periphery of each of said first and second opposing surfaces.

* * * * *